US005626466A

United States Patent [19]

Ruoff et al.

[11] Patent Number: 5,626,466

[45] Date of Patent: May 6, 1997

[54] PISTON PUMP

[75] Inventors: Manfred Ruoff, Moeglingen; Helmut Rembold, Stuttgart; Ernst Linder, Muehlacker, all of Germany

[73] Assignee: Robert Bosch GmbH, Stuttgart, Germany

[21] Appl. No.: 591,581

[22] PCT Filed: May 27, 1995

[86] PCT No.: PCT/DE95/00698

§ 371 Date: Feb. 7, 1996

§ 102(e) Date: Feb. 7, 1996

[87] PCT Pub. No.: WO95/33924

PCT Pub. Date: Dec. 14, 1995

[30] Foreign Application Priority Data

Jun. 8, 1994 [DE] Germany ..... 44 19 927.9

[51] Int. Cl.[6] ..... F04B 1/04; F04B 9/06; F04B 9/04

[52] U.S. Cl. ..... 417/273; 417/470

[58] Field of Search ..... 417/273, 470

[56] References Cited

U.S. PATENT DOCUMENTS

| | | | |
|---|---|---|---|
| 3,141,309 | 7/1964 | Gesell | 417/273 X |
| 3,945,766 | 3/1976 | Gelon | 417/273 |
| 5,004,406 | 4/1991 | Kuroyanagi et al. | 417/273 |
| 5,333,998 | 8/1994 | Yoshida et al. | 417/273 |

*Primary Examiner*—Richard E. Gluck
*Attorney, Agent, or Firm*—Edwin E. Greigg; Ronald E. Greigg

[57] ABSTRACT

A piston pump which is contemplated for furnishing fuel at high pressure, especially gasoline with low self-lubricating properties. To avoid drive-side wear, a rotatably drive eccentric element is provided as the actuating device for the pump piston of the piston pump, the driving motion of the eccentric element being transmitted to the pump piston via a flexible transmission element.

24 Claims, 9 Drawing Sheets

PISTON PUMP

BACKGROUND OF THE INVENTION

The invention is based on a radial piston pump as as set from therein of the kind already known from German Patent Disclosure DE-A1 37 01 857. In that reference, a ring device is provided as the actuating element; on one side of its axial length it is supported on a ball bearing, which in turn is fixed on an eccentric element on the free end of a drive shaft. The known ring device fits over a stublike housing part into which the pump cylinders are radially machined, with pump pistons emerging radially outward from them and there coming to rest on the ring device via cuplike formations. When the eccentric element is driven, the ring device executes a tumbling eccentric motion, in the course of which the pump pistons are moved alternately inward or outward and in so doing execute their intake and supply strokes. In this embodiment of a radial piston pump, although compared with known versions in which the pump pistons slide via centrally located cam races the transferring motions between the actuating element and the pump piston are relatively slight, nevertheless they are still not entirely prevented in the known embodiment. In particular, depending on the rotary position of the ring device, the pump pistons each assume positions in which they are not at right angles to the inside surface of the driving ring device. As a result, there are still shear forces at the point of contact of the pump pistons with the ring device and sliding friction, since because of the construction the surface of the ring device shifts relative to the pump pistons. The known radial piston pump is contemplated in particular for supplying a hydraulic anti-lock brake system; as the medium to be pumped, pressure fluid can be chosen, which within limits has more lubricant properties. However, if such a pump is to be used to generate pressure in media which have from only slight to no lubricating properties, such as gasoline, then high sliding friction must be expected in the contact regions between the pump pistons, leading on the one hand to increased power loss when the radial piston pump is driven and on the other to increased wear. Because of abrasion of material and scuffing with a strong draft on the driving side of the pump pistons, a considerably limited service life must be expected. Pumps that are exposed to gasoline in this region behave as if they were run dry when lubricated.

ADVANTAGES OF THE INVENTION

The radial piston pump of the invention has the advantage over the prior art that by the drive of the piston pump via a flexible transmission element in each case, sliding friction between the pump piston and its actuating element is precluded entirely. No sliding friction occurs, and hence friction losses and wear are averted. The pump thus becomes highly suitable for pumping fuel, especially gasoline, which is fed at high pressure into a pressure reservoir from which the fuel is supplied under electrical control to a fuel injection nozzle by way of which the fuel is injected into an internal combustion engine.

With the embodiment as set forth herein the advantage is attained in particular that because of the transmission element and the transmission part together with the annular part, a longitudinally symmetrical quadrilateral is formed that can be shaped into a parallelogram without the presence of ring joints that involve sliding friction. Because the annular part is rotatably supported on the eccentric element, the relative association of the alignment of the transmission part and the alignment of the annular element upon a deflection thereof via the eccentric element is preserved. With the embodiment set forth a construction that is especially easy to realize is attained, in which the parts of the transmission element extending parallel to one another can be placed in face-end grooves of a part that receives the pump cylinder. Especially advantageously, a deflection arrangement on the annular part that cooperates with the transmission part is provided in order to generate the parallel course of the parts of the transmission element. According to the invention, at the regions where the parts of the transmission element are in contact, circular-cylindrically extending surface parts are provided, on which the two parts of the transmission element can be unwound or wind up upon a displacement of the transmission part relative to the annular part. Advantageously, the transmission element comprises flat band material, which has great flexibility in the direction of the plane of deformation with a high transmission cross section and hence a high capacity for bearing loads. Another advantageous feature is that the annular part is supported on the eccentric element in a manner separated from and sealed off from the remainder of the gasoline-filled housing. Good bearing conditions are thus attained while avoiding dry running that is possible under the influence of the gasoline, as noted above. In a modification of this, a bellows that encloses the bearing and the end of the eccentric element is provided, and a device is furnished by which lubricant can be introduced into the region of the bearing of the annular part on the eccentric element, which region is encapsulated from the interior that is filled with gasoline. According to the invention, pressure fluid lubrication can be realized, since because of the spring fastened between the outside of the bottom and the housing wall, the axial position of the annular part is secured against the inflowing lubricant pressure.

Further advantages of the features of the invention recited hereinafter will become apparent from the ensuing description.

BRIEF DESCRIPTION OF THE DRAWINGS

Four exemplary embodiments of the invention are shown in the drawings and described in further detail in the ensuing description.

DETAILED DESCRIPTION OF THE EXEMPLARY EMBODIMENTS

Figure 1:
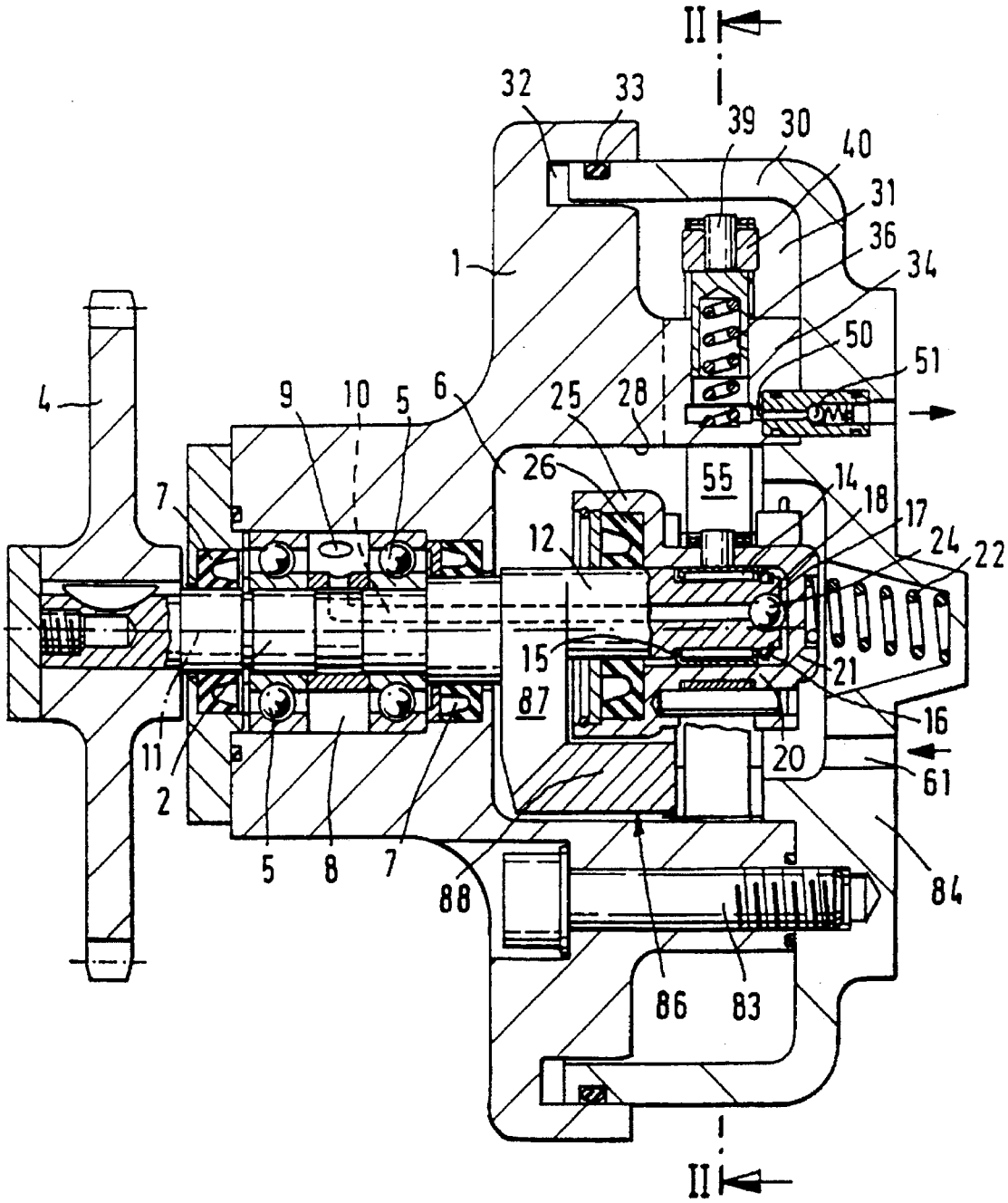
FIG. 1 is a longitudinal section through the radial piston pump of the invention in a first exemplary embodiment.

The radial piston pump shown in FIG. 1 has a pump housing 1, in which a drive shaft 2 of the radial piston pump is supported. A driving gear wheel 4 is secured to the drive shaft on its end protruding from the pump housing. The shaft is supported by means of two spaced ball bearings 5, which are sealed off from the outside and from an interior 6 of the radial piston pump by seals 7, so that no fuel can escape along the drive shaft to the ball bearings from the interior 6, which is filled with gasoline.

Figure 2:
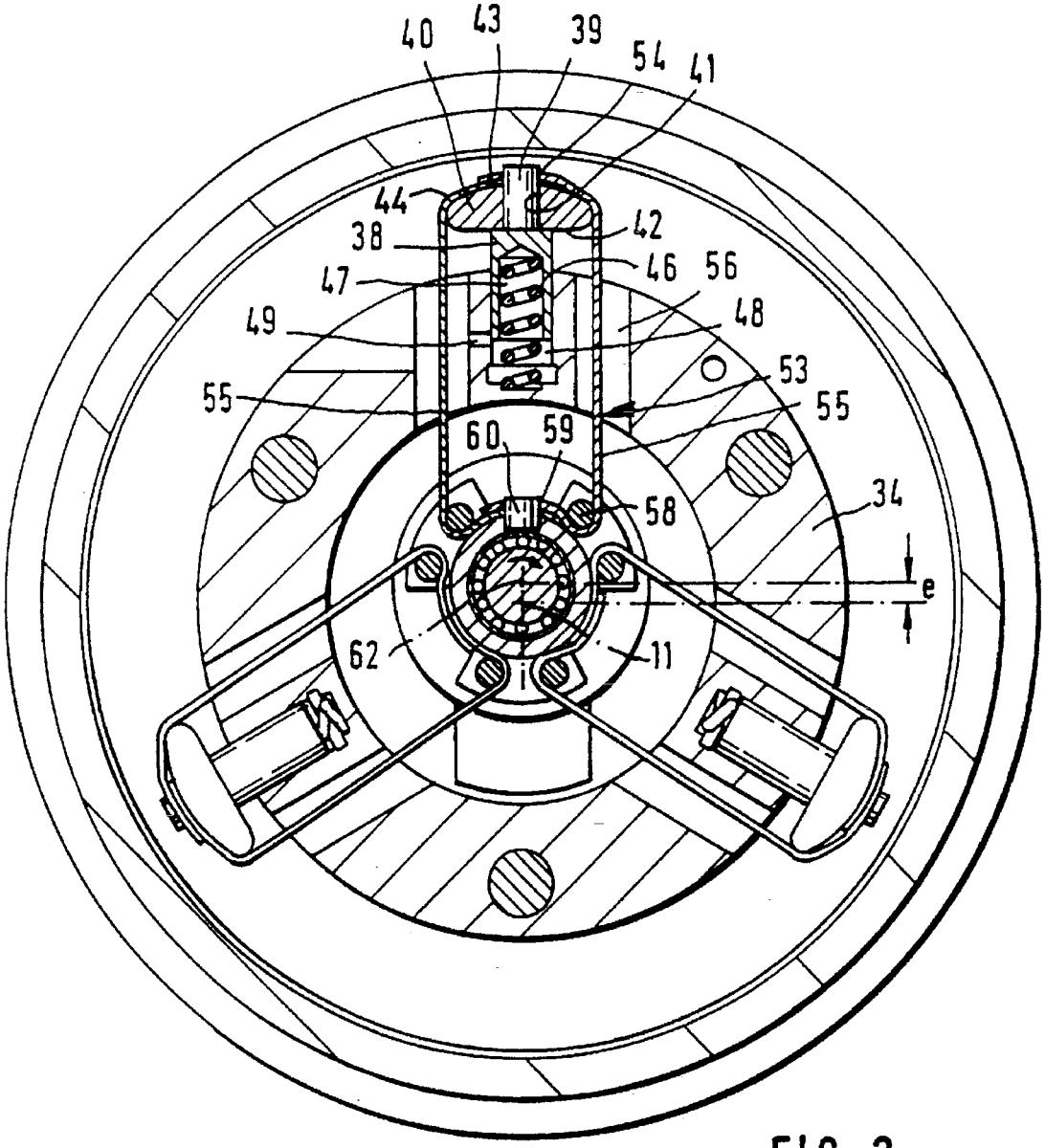
FIG. 2 is a section taken along the line II—II of FIG. 1 through the first exemplary embodiment.

On its end protruding into the interior 6, the drive shaft has a tang-shaped eccentric element 12 that is eccentric with respect to the center axis 11 of the drive shaft, with the eccentricity e that can be seen from FIG. 2. A roller bearing is disposed on the eccentric element; in the exemplary embodiment it is a needle bearing, which for space reasons for example has only one needle cage and one running bush and is secured axially between a shoulder 15 and a securing ring 16 that has a sliding disk. Supported on the needle bearing is an annular part 20, which in the present case is cup-shaped, with a bottom 21 that is opposite the face end 17 of the eccentric element 12; this bottom 21 is retained there, in contact with the inside of the bottom against a ball 24, by a compression spring 22 that engages the outside of the bottom and is braced against a housing cap 23; the ball is inserted into an outlet opening 18 of a lubricant conduit 10 extending axially through the eccentric element 12. The lubricant conduit 10 enters the drive shaft radially in the region between the two ball bearings 5 and is supplied with lubricant from a source of lubricant, not shown in further detail, by a lubricant supply opening 9 that discharges into the annular groove 8 disposed between the two ball bearings. As the lubricant, grease or lubricating oil that is supplied under pressure can be used. Particularly in the latter case, the compression spring 22 is needed in order to keep the annular part 20 in its intended position, which is defined by the ball 24. In the case of lubrication with grease, no significant axial forces occur. In that case, the compression spring can be replaced with a ball, which secures the position of the annular part against axial accelerations transmitted from the engine.

On its end remote from the bottom 21, the annular part 20 has a diameter widening 25, which serves to receive a shaft seal 26. Hence a closed chamber is formed between this shaft seal and the interior of the cup-shaped annular part, and the chamber is filled with lubricant for lubricating the needle bearing 14. Instead of a needle bearing, a slide bearing can also be used, which given a suitable pairing of material can also be embodied as a dry-running bearing, in which case a corresponding supply of lubricant and the shaft seal can be omitted.

The interior 6 is formed by a cup-shaped recess in the pump housing 1, and with its cylindrical wall 28 it encompasses the eccentric element 12 and the annular part in the circumferential direction. On the face end, the interior 6 is closed with the cap 23, which is likewise cup-shaped and which with its cylindrical wall 30 encloses the housing 1, forming an annular chamber 31; for tight closure of the annular chamber 31 from the outside, the end of the cylindrical wall of the cap engages an annular end groove 32 of the pump housing 1 and there enters into a tight connection with the outer annular boundary wall of the annular end groove 32, via a seal 33 that is placed in an outer annular groove of the cylindrical wall 30. Since a pressure higher than the atmospheric ambient pressure prevails in the annular chamber 33 during operation of the radial piston pump, the pressure difference between the annular chamber 31 and its surroundings reinforces the tight contact of the cylindrical wall 30 with the seal 33 at the cylindrical wall of the annular groove 32.

In the annular web 34 of the pump housing formed between the pump interior 6 and the annular chamber 31, pump cylinder bores 36 are provided, which are embodied as cylindrical blind bores arranged radially to the center axis 11 and originating at the annular chamber 31. In the example described, three such cylinder bores 36 are arranged at equal angular spacings from one another. They each receive one pump piston 38, which on its portion protruding outward into the annular chamber, on its face end in an axial extension, has a tang 39 onto which a transmission part 40 is mounted with its bore 41. The transmission part is embodied prismatically and is mushroom-shaped in cross section; it has a lower plane surface 42, which comes into contact with the remaining face end of the pump piston, an upper curved face 43 of large radius, and a curved face 44 adjoining the latter face and having a small radius. With respect to a plane passing through the pump piston axis and the center axis 11, the transmission part is embodied symmetrically.

A compression spring 46 is disposed inside the cylinder bore 36 and is supported in an axial blind bore 47 in the pump piston 38. In the cylinder bore, the pump piston encloses a pump work chamber 48, which is supplied with pressure fluid, in this case gasoline, during the intake stroke of the pump piston via a radial or inlet bore 49, which is controlled by the jacket face of the pump piston. In the compression stroke of the pump piston, the radial bore is closed, and the trapped pressure fluid is supplied, via a pressure conduit 50 leading away from the bottom of the cylinder bore 36 and containing a check valve 51 that opens in the outflow direction, to a pressure reservoir from which fuel injection nozzles, for instance, are supplied with fuel, although this is not shown in further detail here.

The pump piston is driven by the eccentric element 12. To that end, a flexible transmission element 53 is provided between the pump piston and the annular part 20 supported rotatably on the eccentric element. This transmission element, in the example described in conjunction with FIGS. 1 and 2, comprises band material, preferably band steel, which is placed over the curved surface 43 of large radius of the transmission element 40 and there is pierced, in the region of a positive-engagement opening 54, by the tang 39 as a pendant of a positive connection. This secures the transmission element against shifting on the transmission part. After deflection at the curved surface 44 having the smaller radius, the transmission element, in two parts 55 parallel to one another, extends through face-end recesses 56 of the annular web 34 to the annular part 20. There, the parallel parts 55 of the transmission element 53 are deflected at cylinder pins 58, which are inserted axially parallel to the axis of the eccentric element into the annular part 20, and then follow the cylindrical outer face of the annular part 20 between the two cylinder pins 58, until with their ends, which likewise have positive engagement openings 59, they positively engage a corresponding positive engagement tang inserted radially into the annular part. The cylinder pins 58 have the same radius as the curved faces of the transmission part that have the small radius, and the spacing of the centers of the curvature of this face is equal to the spacing between the axes of the cylinder pins. In this way, by way of the thus bent transmission element in the form of flat band material, a rectangle is formed, comprising the two sides parallel to one another of the parts 55 of the transmission element and the imaginary connection between the centers of curvature of the curved faces of small radius 44 of the transmission part and the imaginary connection between the axes of the cylinder pins 58, which imaginary connections are parallel to one another. The parts 55 extending parallel to one another are located in front of and behind the pump piston in terms of the direction of rotation of the eccentric element, which is also accomplished for instance by having them located in a common plane that is radial to the axis of the drive shaft.

Via the end recesses, which are provided to the left and right of the pump piston parallel to it, the annular chamber 31 communicates hydraulically with the interior 6. The interior is supplied with fuel via a fill opening 61, and the fuel can then be supplied to the pump work chamber 48 via the radial bore 49 that discharges into the face-end recess.

In operation, the center point of the eccentric tang moves circularly about the center axis 11 of the drive shaft and in so doing advances the annular element 20. Beginning at the position of the one pump piston 38 in FIG. 2, at which the axis 62 of the eccentric element is at bottom dead center with respect to the upper pump piston 38 and pumping, the pump piston 38 subsequently moves inward upon further rotation of the eccentric element in the direction of the arrow. In this process, the annular part 20 moves to the right from its middle position shown, so that a parallelogram is now created from the rectangle formed by the transmission element 53 and the transmission part 40. The rotary position of the annular element is maintained in this process, and so the connection between the axes of the cylinder pins 58 is still parallel to the transmission part. The left-hand portion 55 of the transmission element must rest somewhat on the left-hand, curved surface 44 of the transmission part and unwind from the cylinder pin 58 located below it. This process takes place in corresponding fashion in turn for the others of the parallel parts 55. As a consequence, the pump piston 38 executes its compression stroke and from the now-closed pump work chamber 48 pumps the pressure fluid into the pressure conduit 50. During this process, the pump piston adjacent to it in the rotary direction executes an outward motion, corresponding to its intake stroke, while the pump piston adjacent to the pump piston 38 counter to the direction of rotation is approximately at the end of its compression stroke. The actuating devices of the pump pistons comprising the annular part 20 and the respective transmission element 53 and the transmission part 40 do not affect one another, as is readily apparent. In this way, the motions of the eccentric element are transmitted to the pump pistons without sliding friction or friction losses. The equal-length radii on which the parallel parts unwind or wind up guarantee an exact parallel guidance without any relative sliding motion and very low actual pressures. The annular element does not execute any rotary motion with respect to the axis 62 of the eccentric element; on the contrary, the eccentric element itself moves beneath the annular part. Because the parallel parts 55 are deflected from the rectangular form to the parallelogram, a gentle startup of the respective pump piston supply stroke results, which is advantageous for reducing pressure pulses and for reducing noise production. This special actuating device of the pump pistons makes it possible to operate the radial piston pump, bathed by gasoline, with the least possible wear. Conversely, the parts that run on one another, that is, the annular part and the eccentric element 12, are housed inside a closed space, partitioned off from the interior 6 that is filled with gasoline, so that once again wear is kept low and a long service life of the radial piston pump when operated with gasoline as the pressure fluid is attained. Because the annular part 20 executes not a rotary motion but only a revolving motion around the center axis 6, it is possible for it to be kept in position with the aid of the compression spring in the face of axial accelerations that are transmitted from the engine.

In the above description, the two parallel parts 55 of the transmission element 53 are two single belts or bands, overlapping one another in the region of the tang 39 or the tang 60, that each have the respective positive engagement opening 54 and 59 and are welded together to secure them. Other kinds of connections are also possible, such as lock-seaming, screw fastening and the like. An endless band or belt, made to the exact required length and accordingly having an annular form without the overlaps shown, is also advantageous. In the choice of material for the transmission element, a flat band of metal is advantageous. Although because of its intrinsic elasticity it cannot be deformed as easily as a nonsteel material, nevertheless the energy invested for the deformation is recovered again virtually completely in the course of the successive stages of operation. If a transmission element of woven belting is used instead of steel, for instance, then a power loss from internal heating of the material upon its deformation must be expected. Thanks to the use of flat band material, it is also readily conceivable to employ other cross-sectional shapes of the transmission element, although in the present case flat band material has advantages in terms of geometric guidance and because of its high flexibility in the circumferential direction relative to the annular part. The interior 31 or 6 of the radial piston pump is supplied during operation by a prefeed pump with a fuel that is at a pressure of approximately 3 to 5 bar and is brought by the radial piston pump to pressures higher than 100 bar, for instance.

Figure 4:
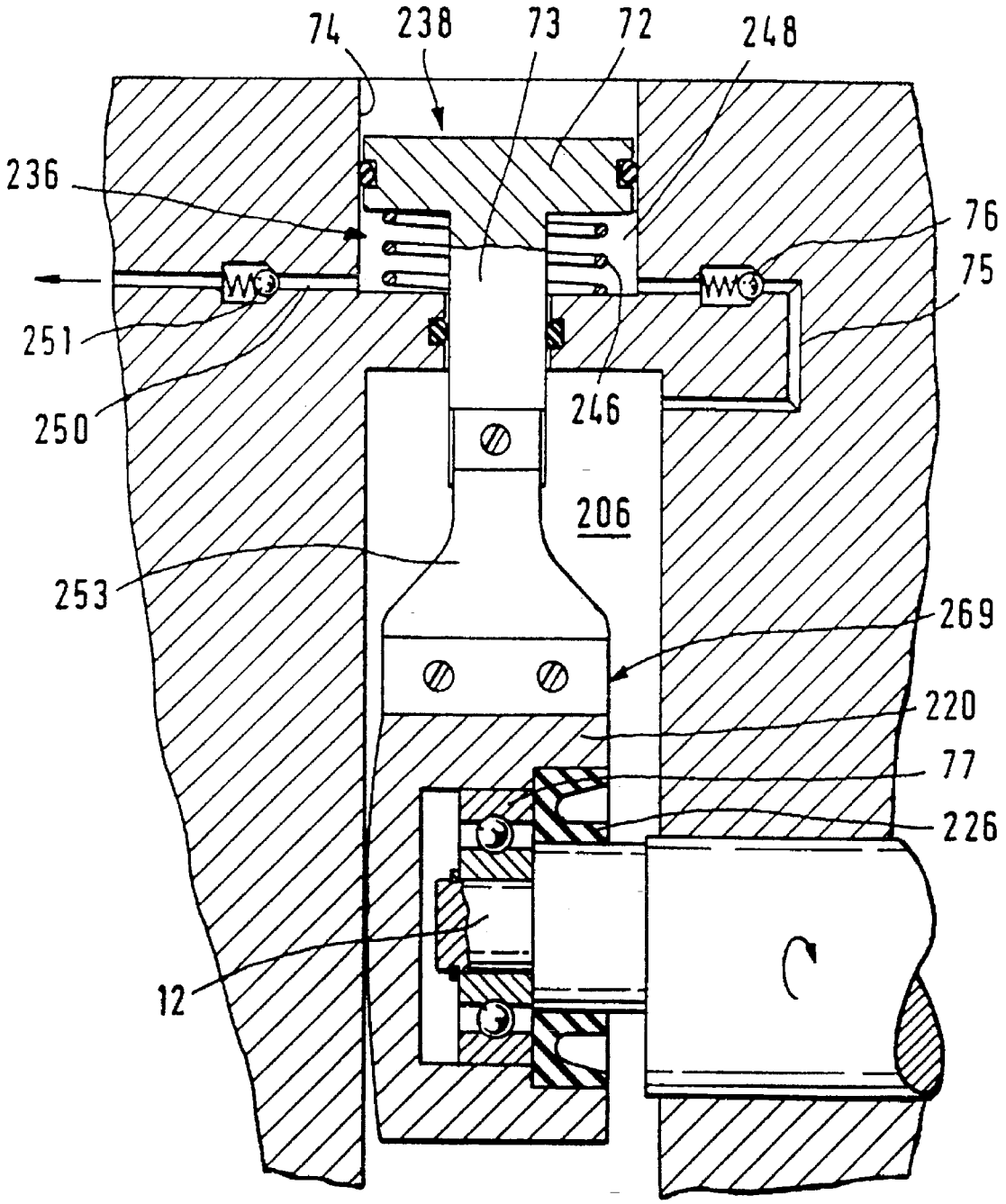
FIG. 4 shows a third exemplary embodiment with one single band, as a transmission element, per pump piston.
Figure 7:
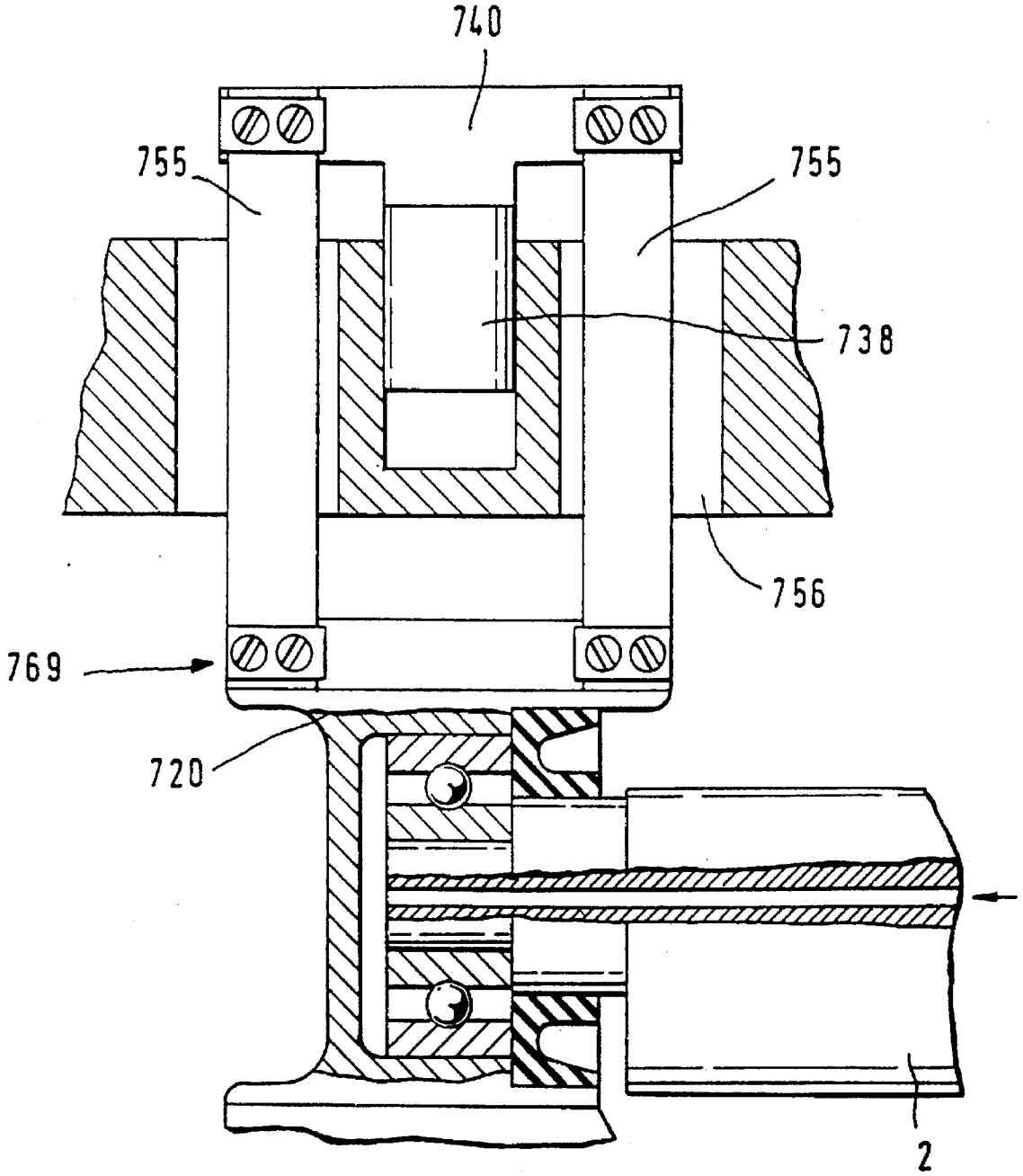
FIG. 7 shows a fourth exemplary embodiment with a two-piece transmission element located longitudinally to the axis of the drive shaft.

In a modification of the embodiment shown in FIGS. 1 and 2, the transmission element may also be formed by two parallel flat bands 755, located side by side with their plane pointing in the circumferential direction, as shown in FIG. 7; both are secured on one side to the annular part 720, for instance to a radially protruding rib 769 corresponding to the rib 249 of FIG. 4, and on the other are secured to a bridgelike part 740 acting as a transmission part. This latter part engages the pump piston 738 located between the flat bands. The flat bands are guided through the housing that divides the interior 6 from the annular chamber 31 by means of a suitable recess 756. They too can be readily deformed, following the course of deflection of the annular element, and transmit the axial forces symmetrically to the pump piston.

Figure 3:
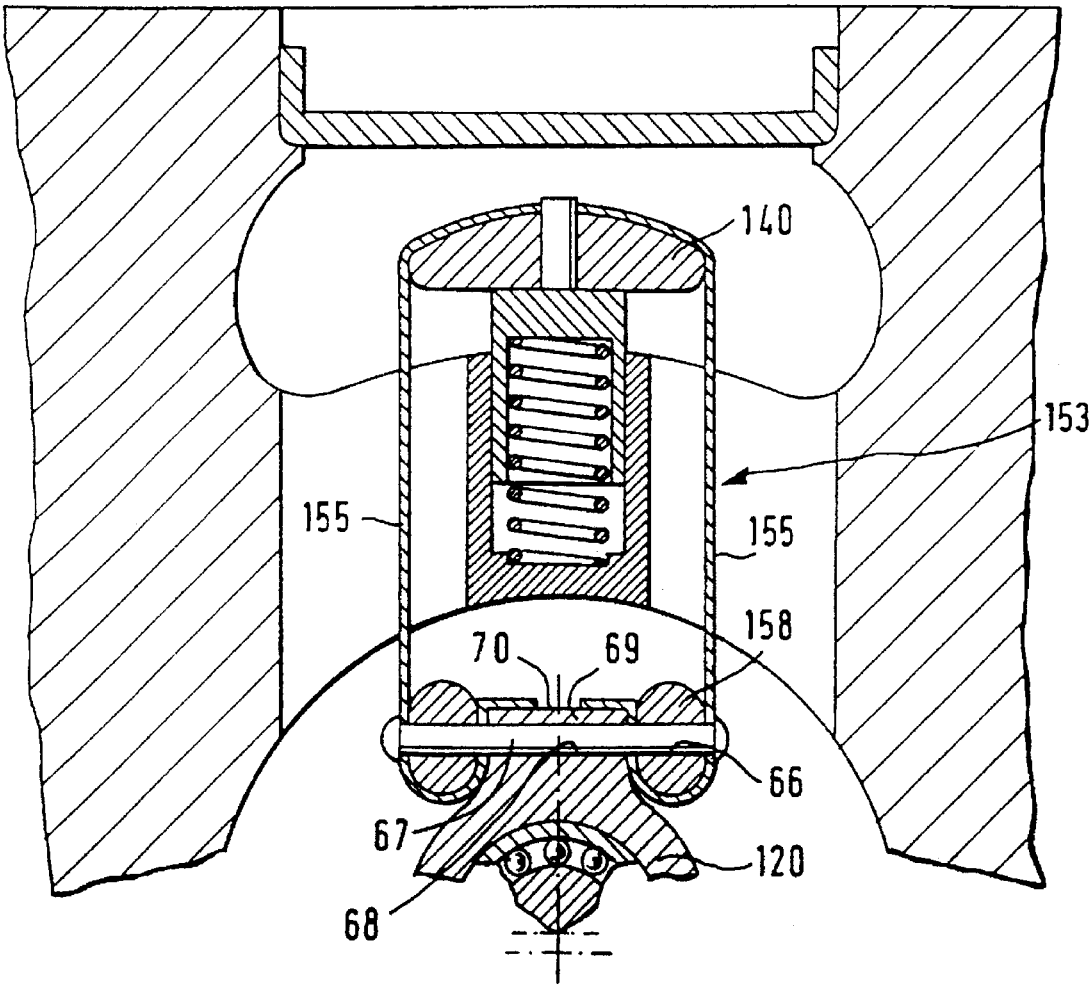
FIG. 3 is a fragmentary elevation view similar to the section of FIG. 2 for a second exemplary embodiment.

A modification of the embodiment shown in FIGS. 1 and 2 can moreover be found in FIG. 3. There the transmission element 153, made in a single piece, is placed with a corresponding guidance over the transmission part 140 and deflected via deflector pieces 158 on the side of the annular part 120 in such a way that once again two parallel parts 155 are created in the intermediate region between the transmission part 140 and the annular part 120. Once again, the deflector part is preferably cylindrical in cross section and has a central transverse bore 66, through which a transverse bolt 67 is drawn vertically to the plane of the band and to the deflector part 158; this bolt is guided by a corresponding bore 68 in a radially protruding rib 69 of the annular part 120. The end of the transmission element 153 is fastened between this rib and the deflector part 158 and bent onto the face end 70 of the rib 69. The result is accordingly a very good positive connection between the ends of the transmission element 53 and the annular part 120; the ends of this transmission element 153 are pierced twice to allow the passage of the bolt 67.

Figure 5:
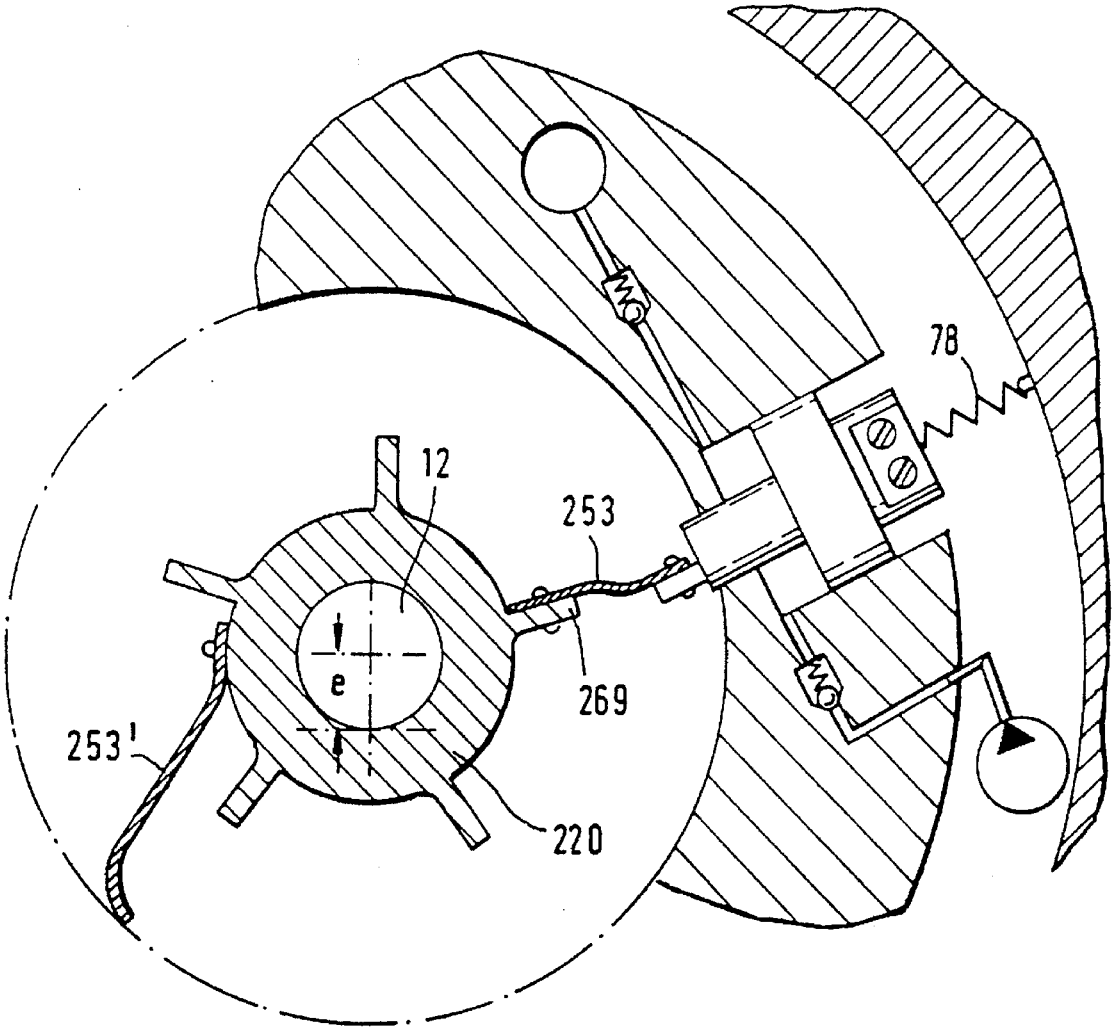
FIG. 5 is an axial view on the exemplary embodiment of FIG. 4.

In the above embodiment, the greatest possible spacing has been chosen between the pivotable connection to the pump piston and the pivotable connection to the annular part, as a result of which it is attained that the respective transmission element 53 or 153 is not very severely deformed. If one wishes to allow a greater deformation, then the radial piston pump according to the invention could also be embodied in accordance with FIG. 4. In that case, the pump piston 238 is embodied as a piston that is guided in a corresponding cylinder bore 236 embodied as a stepped bore. The larger-diameter part 72 of the stepped bore 238 acts as the actual pump piston, which together with its smaller-diameter part 73 encloses the pump work chamber 248 in the larger-diameter bore 74. In turn, a compression spring 246 is disposed in the pump work chamber and moves the pump piston backward in its intake stroke motion. In this exemplary embodiment, such a spring can also, as a tension spring, engage the outside of the pump piston, as shown in FIG. 5. Once again, the pump work chamber 248 is supplied with fuel via an intake line 75, which, with the omission of control by the pump piston itself, now includes a fill check valve 76.

Via a corresponding pressure conduit 250 and the feed pressure valve 251, the compressed fuel is fed to the reservoir, not otherwise shown. For driving the pump piston, the smaller-diameter stepped piston part 73, which on the end remote from the pump work chamber 248 protrudes into the interior 206, is connected there with a transmission element 253 that is modified compared with the preceding exemplary embodiments. This element comprises a leaflike part, which is connected on one end to the end of the smaller-diameter stepped piston part 73 and on the other to an axially extending rib 269 that protrudes radially from the annular part 220. In this exemplary embodiment shown, the annular part 220 is now supported by a ball bearing 77 on the eccentric element 12; this bearing can absorb both radial and axial forces, so that axial securing of the annular part 22 is unnecessary. Otherwise, it is embodied in the same way as the annular part 20 of FIG. 1; that is, it is cup-shaped, with a lip seal 226 closing off the interior of the cup-shaped part.

FIG. 5, in a modification of FIG. 4, is an axial plan view on this exemplary embodiment, which shows that the leaf-like transmission element 253 can deform in accordance with the offset e of the eccentric element 12. There the pump piston is urged radially outward, as schematically represented by a tension spring 78 suspended from the housing. In a modification, the transmission element 253' may also be secured on the circumferential face of the annular part 220, as FIG. 5 shows, instead of on a rib 269.

Figure 6:
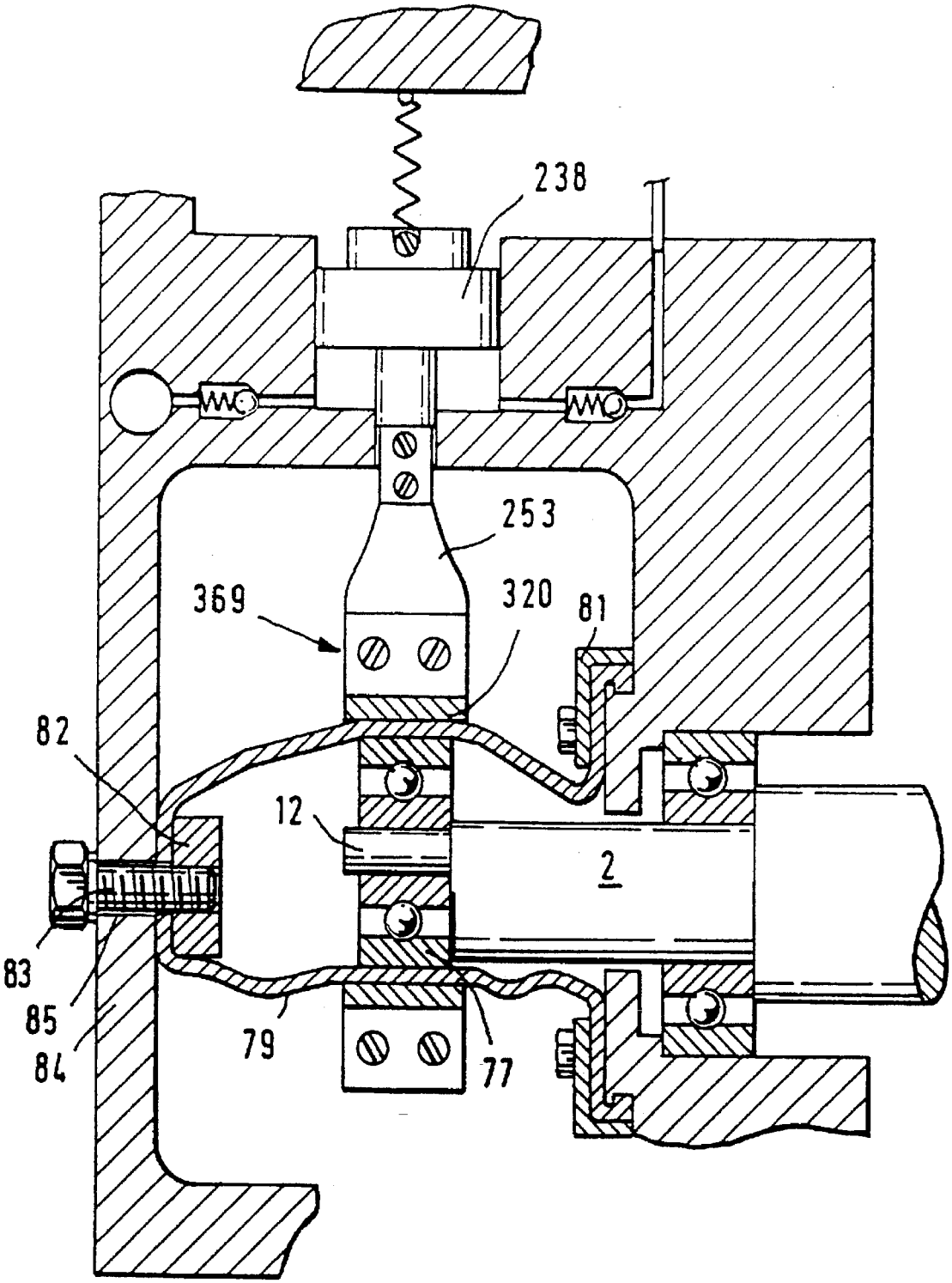
FIG. 6 shows a modified form of the sealing of the bearing on the eccentric element with reference to the exemplary embodiment of FIG. 4.

FIG. 6, finally, shows a modified form of the exemplary embodiment of FIG. 4 in which the annular element 320 is now only annular, with radially protruding ribs 369, on which the leaflike transmission elements 253, already known from FIG. 4, are secured in order to actuate the steplike piston 238. For sealing off the bearing point of the annular element 320, a bellows 79 embodied in the form of a bag is now fastened between the ball bearing 77 of FIG. 4 and the annular element 320; with its outer ends, the bellows is joined tightly via flanges 81 to the end wall of the pump housing that surrounds the outlet of the drive shaft 2. Located inside the baglike bellows are then the outlet of the drive shaft 2, the eccentric element 12, the ball bearing 77, and a fastening element 82, which has a threaded bore into which the end of a screw 83 can be inserted that is passed through the housing wall 84 of the pump housing in a bore 85, passes through an opening in the bottom of the baglike bellows, and upon being screwed into the fastening element 58 fastens the adjoining part of the baglike bellows between the fastening element and the housing wall, thus tightly sealing the interior of the bellows.

However, this embodiment has the disadvantage that a mass compensating means, of the kind contemplated in the exemplary embodiment of FIG. 1, cannot be used. In the latter, in order to avoid imbalances from the eccentric position of the eccentric element, and the parts with mass that run on it, a balancing of weight is provided in the form of a part with mass 86 as a compensating mass, which is embodied initially as a radially extending part 87 protruding from the drive shaft 2 and then as a part 88 extending axially parallel and fitting over the annular element 20, located diametrically to the eccentricity of the eccentric element. However, if the mass mounted on the eccentric element can be reduced by using a slide bearing instead of a roller bearing, which slide bearing also has dry-running properties, such that it can be based by gasoline, then the mass of the annular part can also be reduced considerably by omitting the shaft seal 26, and the aforementioned mass compensation can be dispensed with.

Figure 8:
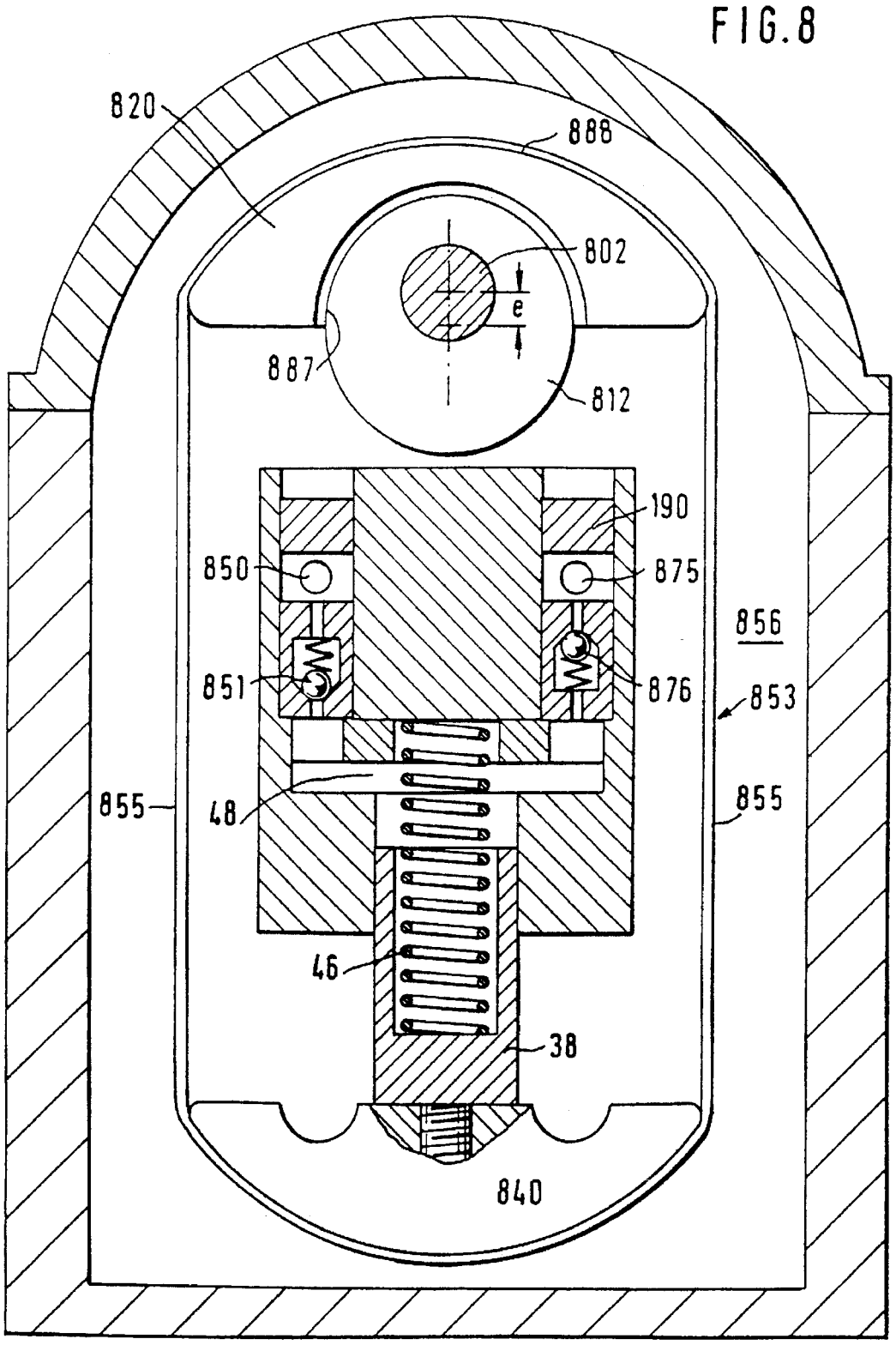
FIG. 8 shows a fifth exemplary embodiment with a partially annular part for securing the transmission element.
Figure 9:
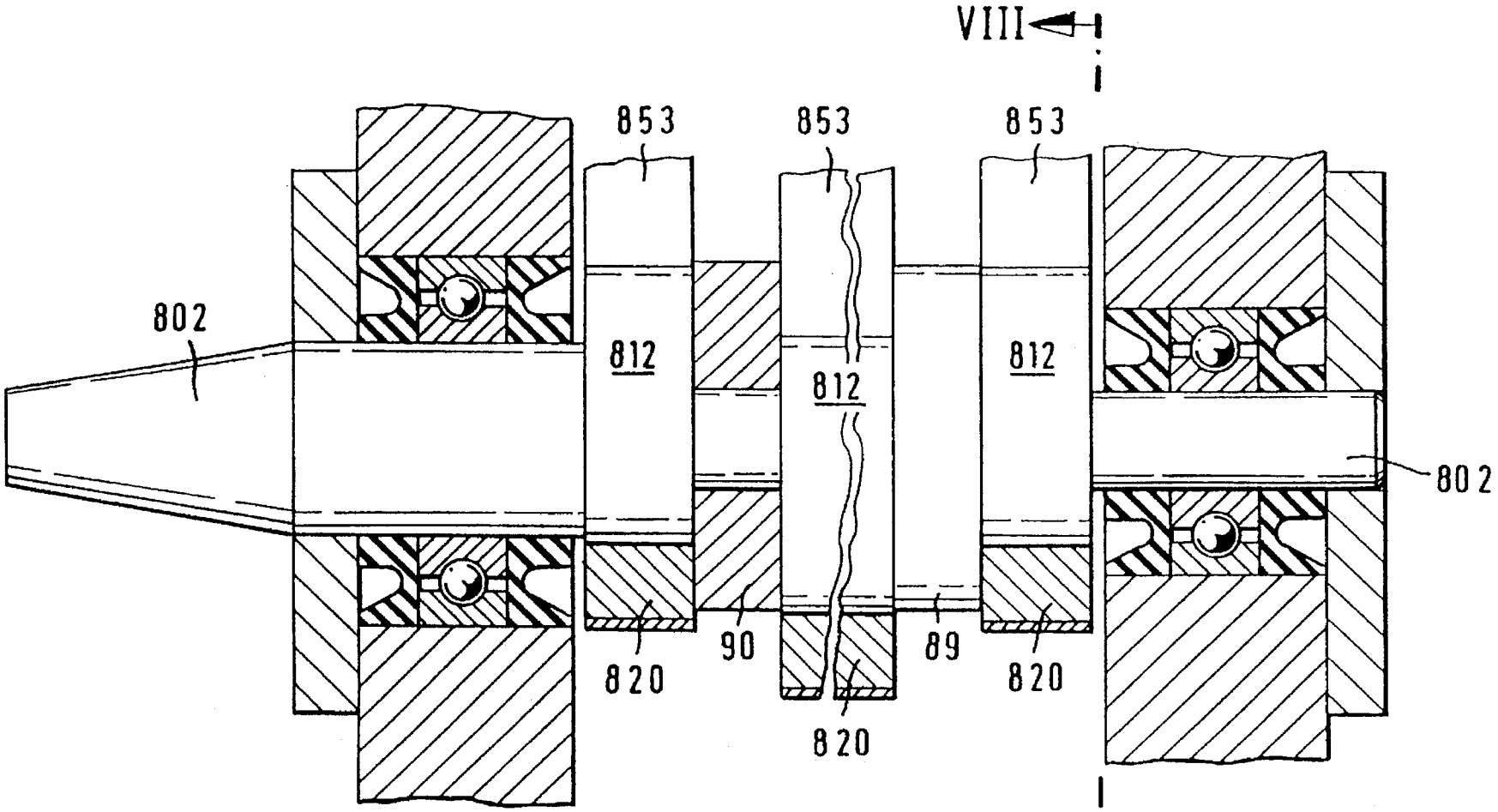
FIG. 9 shows a section at right angles to FIG. 8, illustrating the drive shaft.

In FIG. 8, a fifth exemplary embodiment is shown in section at right angles to the view shown in FIG. 9 of the drive shaft 802 of this exemplary embodiment. This version is suitable for an in-line arrangement of a plurality of pump pistons, to which end the drive shaft 802 is supported on both ends with eccentric elements 812 disposed between them. These eccentric elements are separated from one another either by bearings 90, as shown in the left-hand half of FIG. 9, or by shims 89, as shown on the right-hand half. Bearing shells 820 are supported on the eccentric elements 812 by means of semicylindrical bearing faces 887; with their rounded outer face opposite the bearing face, these bearing shells form a bearing face 888 for a transmission element 853. Consequently the latter element is embodied in the same way as the transmission element 53 of FIG. 2. It branches out at its rounded outer edge, after leaving the bearing shell, into two parts 855 extending parallel to one another, which pass inside the housing through recesses 856 to the transmission part 840, which is embodied identically to that of FIG. 2 and which as also in FIG. 2 acts upon a pump piston 38 counter to the force of a compression spring 46 which is disposed in the pump work chamber 48. The transmission element 853 may be embodied as a continuous band or as bands joined together at one point; the outer contour of the bearing shell 820 in the region of support of the transmission element is embodied analogously to the outer contour of the transmission part 840. The compression spring 46 assures that the transmission element 853 will always be under tension and that the bearing shell 820 is constantly held by its open bearing face on the eccentric element 812, so that it can execute the requisite drive of the pump piston by means of the displacement of the eccentric element.

The pump work chamber 48, which is enclosed by the pump piston in the portion of the housing located between the recesses 856, is again supplied with fuel by a fill check valve 876 and an intake line 875; this fuel, brought to high pressure, is then carried out via the check valve 851 and the pressure conduit 850. The check valves are accommodated in blind bores of the housing that are sealed with stoppers 190.

From FIG. 9 one can see that the bearing shells 820 are guided axially, specially either between the housing wall and an intermediate bearing 90 or between two intermediate bearings in the middle region of the drive shaft 802 or by means of shims 89, provided on the drive shaft 802 between the eccentric elements 820 or the housing wall. This arrangement once again produces a very compact unit with masses in motion that are kept low as a result of the semicircular bearing shells.

The embodiments described here of the piston pump according to the invention may also be used as a hydraulic driving engine or motor, if in a kinematic reversal pressure fluid is supplied in controlled fashion to the pump work chamber from a high-pressure source until the pump piston, now acting as a work piston, has executed its working stroke, which it transmits via the eccentric element 12 to the shaft 2, which is now a power takeoff shaft in the sense of a crankshaft, via the transmission elements 53, 55 and drives them outward and by way of them simultaneously forces another pump piston outward for its return stroke. Once its top dead center is reached, the supply of pressure fluid to the work chamber is discontinued, and a relief line to a relief chamber is opened, so that the pump piston, moved by one or more others of the pump pistons via the eccentric element and the transmission element, can execute its return stroke, in which it pumps the quantity of pressure fluid located in the work chamber into the opened relief line.

The foregoing relates to preferred exemplary embodiments of the invention, it being understood that other variants and embodiments thereof are possible within the spirit and scope of the invention, the latter being defined by the appended claims.

We claim:

1. A piston pump having at least one pump cylinder (36, 236), disposed radially relative to a center axis (11) of a drive shaft (2) in a pump housing (1), a pump piston (38, 238) is driven in said cylinder relative to a pump work chamber (48) toward the center axis (11) for its compression stroke by an actuating element, an inlet bore (49) supplies pressure fluid to said pump work chamber and fluid under a higher pressure is forced from the pump work chamber via an outlet (50) which is controlled by a one-way check valve (51), and the actuating element is supported on an eccentric element (12) driven by the drive shaft (2), the actuating element comprises at least a partially annular part (20, 820) rotatably supported on the eccentric element, and a circumferentially flexible transmission element (53, 153,253) is joined to said actuating element on one end and to the pump piston on another end.

2. The piston pump of claim 1, in which the pump piston is acted upon axially outward by a restoring spring (46, 246, 78, 860).

3. The piston pump of claim 2, in which the pump piston is embodied as a stepped piston (238), and with a smaller-diameter part (73) emerges through a smaller-diameter bore of a steplike cylinder bore (236) receiving the pump piston radially inward to an interior (6) surrounded by the pump housing, and is joined to the transmission element (352).

4. The piston pump of claim 2, in which the transmission element comprises two parallel extending parts (55), which engage a transmission part (40) that is connected to the pump piston (38) disposed between the parallel-extending parts of the transmission element.

5. The piston pump of claim 4, in which the at least partially annular part is a semicircular bearing shell (820), provided with a semi-cylindrical bearing face (87), which shell, on a side opposite the bearing face (88) for the transmission element (853), and the bearing shell with its bearing face (87) is held on the eccentric element (12) by the restoring spring (860).

6. The piston pump of claim 5, in which the drive shaft has at least one eccentric element (812), located between two shims (89) or bearings of the drive shaft, between the shims and/or an axial boundary wall of the bearing the bearing shell is axially guided.

7. The piston pump of claim 4, in which the parts extending parallel to one another of the transmission element are disposed in a common, axially oriented plane.

8. The piston pump of claim 4, in which the parallel-extending parts (55, 155) of the transmission element engage the transmission part (40, 140) in front of and behind the pump piston (38) in terms of the direction of rotation of the eccentric element (12).

9. The piston pump of claim 7, in which the parallel -extending parts (55, 155) of the transmission element are each connected as individual parts to the transmission part and the annular 20 part.

10. The piston pump of claim 7, in which the transmission element is guided via a deflection arrangement (58, 58) on the annular part (20, 120), and via the transmission part (40, 140), with at least one fixation device (54, 39, 60, 59, 67, 68, 69) to prevent longitudinal displacement of the transmission element on one of the annular part or the transmission part.

11. The piston pump of claim 10, in which the transmission element (153) is formed by a single part.

12. The piston pump of claim 10, in which the transmission element is an annular element.

13. The piston pump of claim 9, in which the parallel-extending parts (55) of the transmission element have a positive engagement part (543, 59) on their ends, with which they engage corresponding positive engagement parts (39, 60) on the transmission part (40) and the annular element (20), respectively.

14. The piston pump of claim 13, in which the positive engagement parts form a hole and tang connection.

15. The piston pump of claim 10, in which the transmission part (40) is embodied prismatically, with a mushroom-shaped cross section and with rounded edges by way of which the transmission element is guided, and the annular part has tangs (58) as a deflection arrangement, between which the parallel extending parts (55) of the transmission element rest, with their ends having positive engagement parts, on the annular part and there enter into a positive connection with the annular part.

16. The piston pump of claim 15, in which a rounded portion (44) of the transmission part forms a partial circle in cross section, whose diameter is equal to the diameter of the deflection device formed by a plurality of cylindrical pins (58).

17. The piston pump of claim 3, in which the transmission element comprises a flat band material with a band plane whose extent is at right angles to the center axis.

18. The piston pump of claim 1, in which the transmission element comprises a flat band material with a band plane that is parallel with the axis.

19. The piston pump of claim 3, in which the annular part (20), on one axial end, has a bottom (21) that closes off the annular part and encompasses a face end of the eccentric element (12), and on another axial end has a sealing element (26) that cooperates with the eccentric element.

20. The piston pump of claim 1, in which a compensating mass part (88) extending partially parallel to the eccentric element (12) is disposed on the drive shaft (2) diametrically from the eccentric element.

21. The piston pump of claim 3, in which a bellows (79) tightly surrounding the eccentric element is connected to the annular part.

22. The piston pump of claim 21, in which the bellows is fastened between the annular part (32) and roller bearings (77) and on one end is tightly joined to the pump housing surrounding an outlet of the drive shaft and is joined to a housing wall opposite a face end of the eccentric element.

23. The piston pump of claim 18, in which a lubricant outlet opening (18) is provided on a face end of the eccentric element, in which opening a ball (24) is supported, on which ball the bottom of the annular part (20) is held by a spring (22) fastened between an outside of the bottom and a housing wall.

24. The piston pump of claim 1, in which the piston pump has a controlled inflow of pressure fluid from a high-pressure source to the pump work chamber (48) and a controlled outflow of pressure fluid to a relief chamber.

* * * * *